US012055004B2

(12) United States Patent
Han

(10) Patent No.: US 12,055,004 B2
(45) Date of Patent: Aug. 6, 2024

(54) SYSTEM AND METHOD TO FREE DIFFERENTIALLY STUCK PIPE

(71) Applicant: SAUDI ARABIAN OIL COMPANY, Dhahran (SA)

(72) Inventor: Kyungnam Han, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/054,947

(22) Filed: Nov. 14, 2022

(65) Prior Publication Data

US 2024/0159118 A1 May 16, 2024

(51) Int. Cl.
*E21B 31/107* (2006.01)
*E21B 31/00* (2006.01)

(52) U.S. Cl.
CPC ..... *E21B 31/035* (2020.05); *E21B 31/107* (2013.01)

(58) Field of Classification Search
CPC .... E21B 31/035; E21B 31/107; E21B 21/103; E21B 2200/06
See application file for complete search history.

(56) References Cited

U.S. PATENT DOCUMENTS 8,127,858 B2 * 3/2012 Lynde ..... E21B 23/01 166/212
2008/0308279 A1 * 12/2008 Zazovsky ..... E21B 31/035 166/381
2008/0314587 A1 * 12/2008 Del Campo ..... E21B 49/10 166/264
2012/0261127 A1 * 10/2012 Zhou ..... E21B 21/103 166/118
2016/0160607 A1 * 6/2016 Tahoun ..... E21B 21/103 166/332.3
2020/0149365 A1 * 5/2020 Wilson ..... E21B 29/005
2021/0062633 A1 * 3/2021 Amoudi ..... E21B 17/1014

FOREIGN PATENT DOCUMENTS

WO 2021046115 A1 3/2021

* cited by examiner

*Primary Examiner* — Tara Schimpf
*Assistant Examiner* — Jennifer A Railey
(74) *Attorney, Agent, or Firm* — Vorys, Sater, Seymour and Pease LLP

(57) ABSTRACT

A tubing string release apparatus includes a first mandrel configured to be fixed to an inner wall of a tubing string extended within a wellbore, the first mandrel defining a telescope chamber and a first port that facilitates fluid communication into the telescope chamber, a second mandrel slidably arranged against the first mandrel and defining a second port, and a telescoping cylinder arranged within the telescope chamber and including a telescoping base releasably coupled to the tubing string at an aperture defined in the tubing string, and a telescoping piston releasably coupled to the telescoping base. The telescoping base is advanced radially outward through the aperture when a pressure within the tubing string is increased to a first pressure, and the telescoping piston is advanced radially outward through the telescoping base when the pressure within the tubing string is increased to a second pressure greater than the first pressure.

20 Claims, 6 Drawing Sheets

SYSTEM AND METHOD TO FREE DIFFERENTIALLY STUCK PIPE

FIELD OF THE DISCLOSURE

The present disclosure relates generally to drilling wellbores and, more particularly, to freeing differentially stuck pipe during wellbore drilling activities.

BACKGROUND OF THE DISCLOSURE

A significant issue in drilling a wellbore in the oil and gas industry (or other industries) is differential sticking. Differential sticking occurs when the drilling assembly is prevented from rotating or reciprocating within the wellbore. This may occur due to the formation of a thick layer of mud filter cake (alternately referred to as "mudcake") on the walls of the wellbore. In certain applications, the drilling assembly cannot overcome the hydrostatic pressure of the mud cake. Standard procedures for freeing a drilling assembly experiencing differential sticking (also referred to as "stuck pipe") involve using an oil-base mud as a spotting fluid, using mechanical jarring to apply a shock force, adjusting the wellbore's hydrostatic pressure, or any combination thereof.

Should the previously discussed methods fail to free the stuck pipe, the wellbore may need to be worked over in a fishing operation. Alternatively, a sidetracking operation may be required to move parallel to the original wellbore, which is undesirable. The sidetracking operation may culminate in the successful unsticking of the pipe, or may be used to bypass the stuck pipe and continue the operation below the original well. In both of these cases, the money and time required to proceed with normal drilling operation may become costly. In order to avoid this possibility, additional methods of freeing stuck pipe with higher chances of success are desired.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system includes a tubing string extended within a wellbore, and a tubing string release apparatus secured to the tubing string. The tubing string release apparatus includes a first mandrel fixed to an inner wall of the tubing string and defining a telescope chamber and a first port that facilitates fluid communication into the telescope chamber, a second mandrel slidably arranged against the first mandrel and defining a second port, and a telescoping cylinder arranged within the telescope chamber and including a telescoping base releasably coupled to the tubing string at an aperture defined in the tubing string, and a telescoping piston releasably coupled to the telescoping base. The second mandrel is movable between a first position, where the first and second ports are misaligned, and a second position, where the first and second ports are aligned and fluid pressure is able to enter the telescope chamber via the first and second ports. The telescoping base is released from the tubing string and advanced radially outward through the aperture when a pressure within the tubing string is increased to a first pressure. The telescoping piston is released from the telescoping base and advanced radially outward through a central orifice defined by the telescoping base when the pressure within the tubing string is increased to a second pressure greater than the first pressure.

In another embodiment, a method includes introducing a wellbore projectile into a tubing string extended within a wellbore having a layer of mud filter cake formed on at least a portion thereof, the tubing string including a tubing string release apparatus secured thereto. The tubing string release apparatus includes a first mandrel fixed to an inner wall of the tubing string and defining a telescope chamber and a first port that facilitates fluid communication into the telescope chamber, a second mandrel slidably arranged against the first mandrel and defining a second port, a projectile seat coupled to the second mandrel at a location downhole from the second port, and a telescoping cylinder arranged within the telescope chamber and including a telescoping base releasably coupled to the tubing string at an aperture defined in the tubing string, and a telescoping piston releasably coupled to the telescoping base. The method further includes receiving the wellbore projectile at the projectile seat, increasing a pressure within the tubing string to a first pressure, and thereby moving the second mandrel from a first position, where the first and second ports are misaligned, to a second position, where the first and second ports are aligned to allow fluid pressure to enter the telescope chamber, and increasing the pressure within the tubing string to a second pressure and thereby releasing the telescoping base from the tubing string and advancing the telescoping base radially outward through the aperture and against the mud filter cake.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
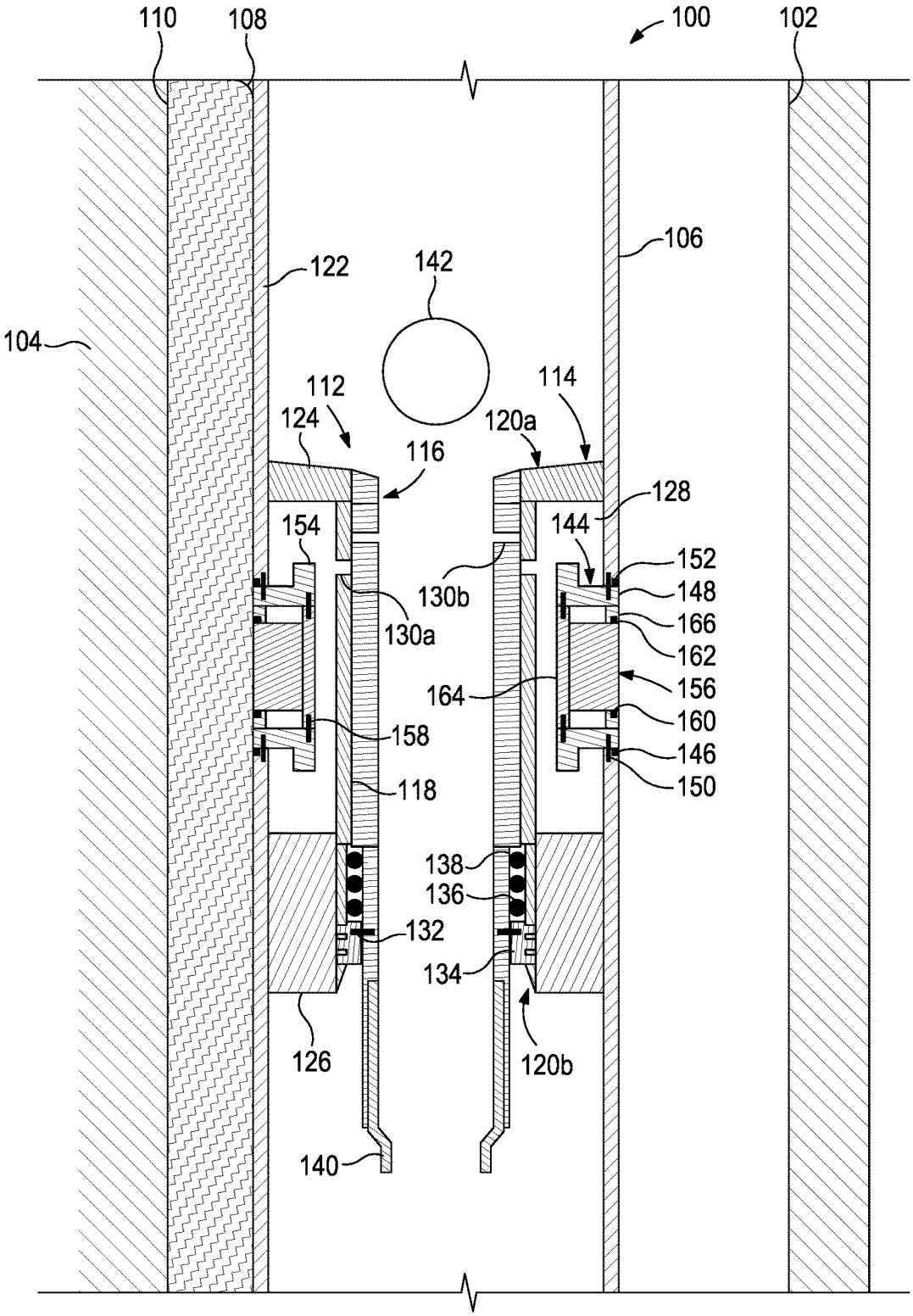
FIG. 1 cross-sectional side view of an example well system that may incorporate or more principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to drilling wellbores and, more particularly, to freeing differentially stuck pipe during wellbore drilling activities. The embodiments described herein include a telescopic cylinder that can be activated by applying fluid pressure at surface, and thereby, physically pushing (urging) stuck pipe radially away from built up mud filter cake deposited on a wellbore wall. Once the pushing force exceeds the differential sticking force of the mud filter cake, the pipe will be released and able to move. At least one advantage to the presently disclosed embodiments is that it will reduce differential sticking force with minimized contact area of stuck pipe, e.g., by lifting the stuck pipe off from the mud filter cake a larger distance due to its telescopic feature. Thus, significant drilling cost and time can be saved, which would otherwise be expended in arduous fishing or sidetrack operations if the pipe cannot be freed. The principles described herein can be employed in multiple places along downhole tubing strings, such as in locations where differential sticking is expected, thus increasing the chances of freeing stuck pipe.

FIG. 1 is a cross-sectional side view of an example well system 100 that may incorporate one or more principles of the present disclosure. As illustrated, the well system 100 includes a wellbore 102 drilled into one or more subterranean formations 104 using, for example, a tubing string 106. In such applications, the tubing string 106 may comprise drill pipe, but in other applications the tubing string 106 may comprise any other type of tubulars or pipes extendable within the wellbore 102, such as casing or wellbore liner. The tubing string 106 may comprise a continuous length of tubing or pipe sections interconnected end-to-end.

As depicted in FIG. 1, the wellbore 102 has a layer of filter cake or mud filter cake 108 formed on at least a portion of its inner wall 110. The mud filter cake 108 may be formed as drilling fluid is forced against the inner wall 110 of the wellbore 102 under pressure, and its thickness (depth) can cause differential sticking of pipes (e.g., the tubing string 106) and other drilling problems. In FIG. 1, the tubing string 106 is undergoing differential sticking against the mud filter cake 108, such that it is prevented from rotating or reciprocating. Accordingly, the tubing string 106 may be referred to as "stuck pipe".

In order to free the tubing string 106, a large force must be applied to overcome the hydrostatic pressure generated by the mud filter cake 108. To accomplish this, the well system 100 may further include a tubing string release apparatus 112 that may be used (operated) when differential sticking of the tubing string 106 occurs. As described herein, the tubing string release apparatus 112 (hereafter "the apparatus 112") may obviate costly fishing or sidetrack operations.

As illustrated, the apparatus 112 may be coupled to or form an integral part of the tubing string 106. While only one apparatus 112 is shown, it is contemplated herein to include two or more apparatus 112 strategically placed along the tubing string 106, such as in locations where differential sticking is expected.

The apparatus 112 may include a first or "fixed" mandrel 114 and a second or "travelling" mandrel 116 movably (e.g., slidably) arranged within at least a portion of the fixed mandrel 114. The fixed and travelling mandrels 114, 116 may be arranged within the tubing string 106.

The fixed mandrel 114 may include an elongate body 118 having a first or "uphole" end 120*a*, and a second or "downhole" end 120*b*. The fixed mandrel 114 may be coupled to an inner wall 122 of the tubing string 106 at one or both of the uphole and downhole ends 120*a,b*. In some embodiments, for example, the uphole end 120*a* may provide or include a radial shoulder 124 that extends radially outward and into contact with the inner wall 122. The radial shoulder 124 may be secured to the inner wall 122 via a variety of securing means including, but not limited to, an interference fit, one or more mechanical fasteners, welding, or any combination thereof.

A seal member 126 may be provided at or near the downhole end 120*b* of the fixed mandrel 114. In some embodiments, the seal member 126 may extend radially between the downhole end 120*b* and the inner wall 122 of the tubing string 106. The seal member 126 may comprise any structural component or device capable of providing a sealed interface between the downhole end 120*b* and the inner wall 122. In some embodiments, for example, the seal member 126 may comprise an elastomeric sealing element, such as an annular seal packer or the like. Alternatively, however, the seal member 126 may merely comprise an annular structural component that facilitates a sealed and secure interface.

In some embodiments, the fixed mandrel 114, including the elongate body 118, the radial shoulder 124, and the seal member 126, may be separate and distinct from the tubing string 106 and coupled thereto. Alternatively, the fixed mandrel 114 may form an integral part of the inner wall 122 of the tubing string 106, without departing from the scope of the disclosure.

Figure 2:
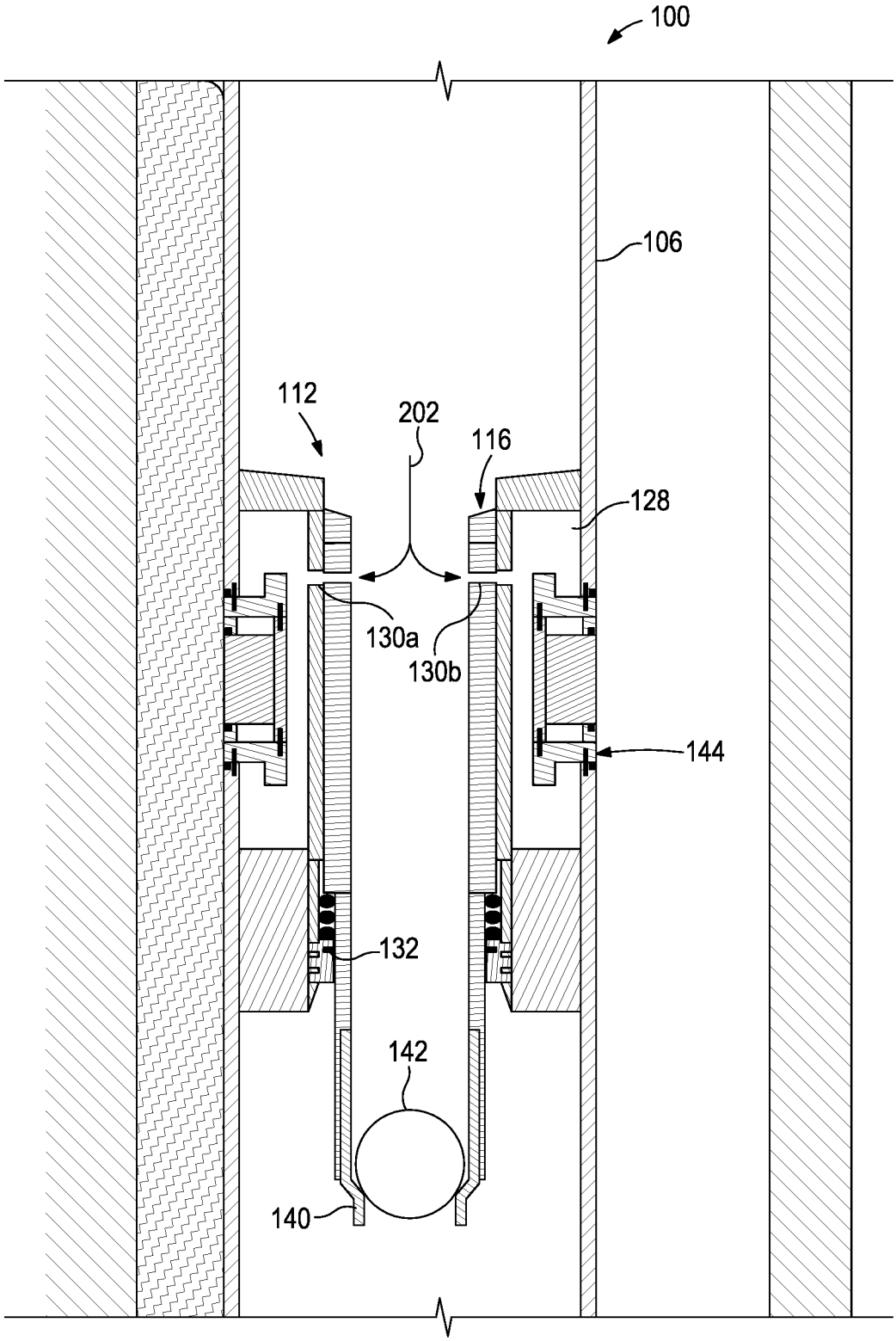
FIGS. 2-5 depict example, progressive operation of the tubing string release apparatus of FIG. 1, according to one or more embodiments.

The combination of the elongate body 118, the radial shoulder 124, and the seal member 126 may cooperatively define a telescope chamber 128. The telescope chamber 128 may be substantially sealed when the travelling mandrel 116 is in a first position, as shown in FIG. 1. However, when the travelling mandrel 116 moves to a second position, as shown in FIG. 2, a first port 130*a* defined in the fixed mandrel 114 (e.g., the elongate body 118) may become exposed and thereby place the telescope chamber 128 in fluid communication with the interior of the tubing string 106, as described in more detail below.

The travelling mandrel 116 may slidably abut the fixed mandrel 114 and is generally movable against an opposing inner surface of the elongate body 118. The travelling mandrel 116 may be releasably attached to the fixed mandrel 114 at a mandrel shearable member 132. In at least one embodiment, the mandrel shearable member 132 may be received within (secured to) a bracket 134 operatively coupled to the downhole end 120*b* of the fixed mandrel 114.

The travelling mandrel 116 may also be spring-loaded against the fixed mandrel 114. More specifically, in some embodiments the apparatus 112 may include a compression spring 136 arranged within a chamber 138 defined between the fixed mandrel 114 and the travelling mandrel 116. Within the chamber 138, the compression spring 136 may bias against the bracket 134 at a lower or downhole end, and against an upper shoulder defined by the travelling mandrel 116. The compression spring 136 may naturally bias the travelling mandrel to the first position. As the travelling mandrel 116 moves between the first and second positions, as described in more detail below, the compression spring 136 will be compressed. Moreover, moving the travelling mandrel 116 to the second position may radially align the first port 130*a* with a second port 130*b* defined in the travelling mandrel 116, and when the first and second ports 130*a,b* are aligned, the telescope chamber 128 will be placed in fluid communication with the interior the tubing string 106.

Those skilled in the art will readily appreciate that while the illustrated embodiment utilizes a compression spring 136, any deforming mechanism which provides initial resistance while ultimately allowing travel with increased force, such as an elastic material or a brittle material, may be used in place of the compression spring 136 without departing from the scope of this disclosure. Accordingly, the compression spring 135 may be replaced with any type of biasing member or device, such as a series of Belleville washers or the like.

The apparatus 112 may further include a projectile seat 140, which may be constructed from a plastically deforming or shearable material. More specifically, the projectile seat 140 may be provided or otherwise defined at the lower end of the travelling mandrel 116. Those skilled in the art will readily appreciate that the projectile seat 140 is not limited in its placement to the bottom of the travelling mandrel 116, rather the projectile seat 140 may be located at any location along the travelling mandrel 116 downhole from the second port 130*b*. As illustrated, the projectile seat 140 may include and inwardly projecting bottom section configured to receive and sealingly engage a wellbore projectile 142 which may be dropped, or otherwise released, down the length of the tubing string 106 in order to activate the apparatus 112. In some embodiments, the wellbore projectile 142 may comprise a spherical ball, as illustrated, but in other embodiments, the wellbore projectile 142 may comprise a wellbore dart or any downhole projectile having any polyhedral shape which may travel the length of the tubing string 106 and properly mate with the projectile seat 140. Once the wellbore projectile 142 is properly mated with the projectile seat 140, fluid pressure within the tubing string 106 may be increased uphole from the wellbore projectile 142 to build pressure within the tubing string 106 to actuate the apparatus 112.

The apparatus 112 further includes one or more telescoping cylinders 144 arranged within the telescope chamber 128. In the illustrated embodiment, the apparatus 112 includes two telescoping cylinders 144 angularly opposite each other about the circumference of the tubing string 106. While only two telescoping cylinders 144 are depicted in FIG. 1, more or less than two may be included. The telescoping cylinders 144 may be equidistantly or non-equidistantly spaced from each other about the circumference of the tubing string 106. Moreover, in some embodiments, the telescoping cylinders 144 may be axially aligned with each other along the longitudinal axis of the tubing string 106, but could alternatively be axially offset from each other (e.g., one may be arranged further downhole or uphole from another), without departing from the scope of the disclosure.

Each telescoping cylinder 144 may be arranged within and otherwise mated with a corresponding aperture 146 defined in the tubing string 106. Moreover, each telescoping cylinder 144 may include a telescoping base 148 sized and otherwise configured to be received within and fit through the corresponding aperture 146 of the tubing string 106. The telescoping base 148 may be releasably secured to the tubing string 106 at the corresponding aperture 146 using one or more shearable members 150, such as a shear pin, a shear screw, etc. Moreover, one or more seals 152 may be arranged at the interface between the telescoping base 148 and the corresponding aperture 146. The seals 152 may comprise O-rings or the like, and may be configured to generate a sealed interface at the location.

As described in more detail below, once the shearable members 150 are sheared or otherwise broken, the telescoping cylinder 144 may be able to telescope (move) radially outward and through the corresponding aperture 146. During this radially outward movement, the seals 152 may maintain the sealed interface between the telescoping cylinder 144 and the aperture 146. The telescoping base 148 may additionally include or define an enlarged base portion 154 having a diameter greater than the corresponding aperture 146. As a result, as the telescoping base 148 proceeds to protrude through the corresponding aperture 146, the enlarged base portion 154 will eventually engage the inner wall 122 and prevent further radial outward movement of the telescoping base 148.

Each telescoping cylinder 144 may further include a telescoping piston 156 releasably secured to the telescoping base 148 at one or more shearable members 158, such as a shear pin, a shear screw, etc. The telescoping base 148 may define a central orifice 160, and the telescoping piston 156 may be sized to be received within the central orifice 160. Further, one or more seals 162 may be arranged at the interface between the telescoping piston 156 and the central orifice 160. Similar to the seals 152, the seals 162 may comprise, for example, an O ring or the like, and may be configured to generate a sealed interface at the location.

Once the shearable members 158 are sheared or otherwise broken, the telescoping piston 156 may be able to telescope (move) radially outward and through the central orifice 160. During this radially outward movement, the seals 162 may maintain a sealed interface between the telescoping piston 156 and the central orifice 160. Moreover, as illustrated, the telescoping piston 156 may define or otherwise include an enlarged base portion 164 having a diameter greater than the central orifice 160. As a result, when the telescoping piston 156 advances radially through the corresponding central orifice 160, the enlarged base portion 164 may be configured to engage a radially protruding member 166 provided by the telescoping base 148, and thereby prevent further radial outward movement of the telescoping piston 156.

Example operation of the apparatus 112 in the well system 100 will now be provided with reference to FIGS. 2-5. As mentioned above, the travelling mandrel 116 is actuatable and otherwise movable between a first or "natural" position, as shown in FIG. 1, and a second or "actuated" position, as shown in FIG. 2. Upon moving the travelling mandrel 116 to the second position, the telescoping cylinders 144 may be able to be activated and otherwise actuated to extend radially outward and thereby release the tubing string 106 from a differentially stuck position against the adjacent mud filter cake 108.

As shown in FIG. 2, the wellbore projectile 142 may be dropped into the tubing string 106 and allowed to descend to the apparatus 112. In some embodiments the wellbore projectile 142 may be pumped to the apparatus 112, but could alternatively descend to the apparatus 112 under the force of gravity. Upon reaching the apparatus 112, the wellbore projectile 142 may locate and mate with the projectile seat 140, following which pressure within the tubing string 106 uphole from the apparatus 112 may be increased. Increased pressure within the tubing string 106 places a downward axial load on the wellbore projectile 142, which acts on the travelling mandrel 116 as connected to the projectile seat 140. The pressure may be increased to a first pressure and otherwise a known pressure point where the mandrel shearable member(s) 132 are able to be sheared or broken, thereby allowing the travelling mandrel 116 to translate (move) downward relative to the fixed mandrel 114 and to the second position. It should be noted that the shearing or breaking of the mandrel shearable member(s) 132, and therefore the travel of the travelling mandrel 116, may be alternatively enabled using a form of mechanical actuation (e.g., hydraulic, mechanical, or electromechanical actuation) or any other means of providing force and/or actuation without departing from the scope of this disclosure.

Transitioning the travelling mandrel 116 to the second position enables the alignment of the first port 130*a* and the second port 130*b*. With the first and second ports 130*a,b* axially aligned, fluids and fluid pressure 202 within the interior of the tubing string 106 can enter (propagate into) the telescope chamber 128 via the aligned first and second ports 130*a,b* and thereby act on the telescoping cylinders 144.

Figure 3:
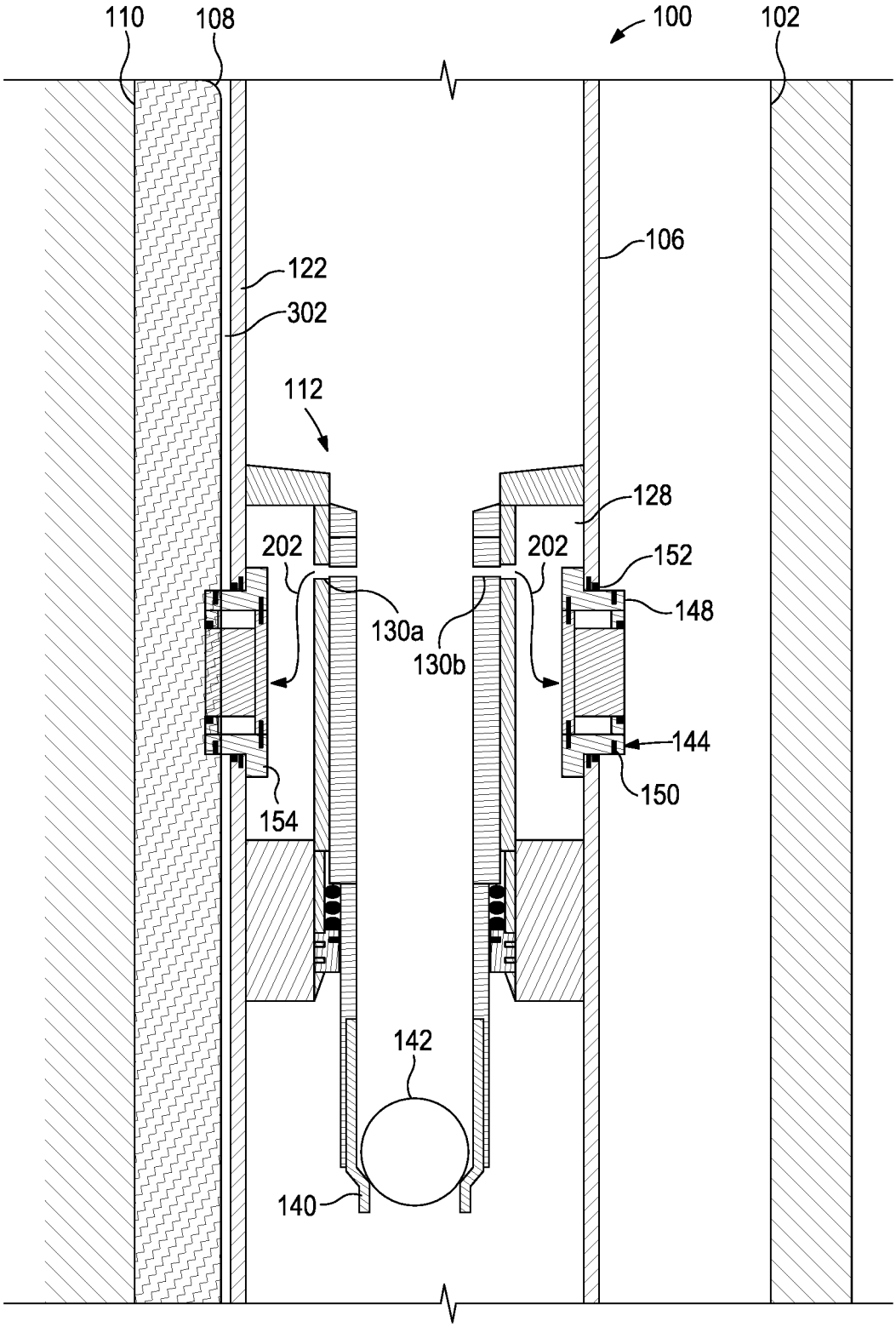

In FIG. 3, the telescoping cylinders 144 have been partially extended (activated) as acted upon by the fluid pressure 202. More specifically, with the fluid pressure 202 propagating into the telescope chamber 128, the telescoping cylinder 144 may begin to transition from a first or "retracted" position, as shown in FIGS. 1 and 2, to a second or "intermediate" position, as shown in FIG. 3. The fluid pressure 202 entering the telescope chamber 128 will place a radial load on each telescoping cylinder 144, which may result in the shearing of the shearable members 150, thereby allowing the telescoping base 148 to radially advance and protrude through the aperture 146 in the inner wall 122 of the tubing string 106. The telescoping base 148 advances radially outward until the enlarged base portion 154 of the telescoping cylinder 144 contacts the inner wall 110 of the tubing string 106.

In some embodiments, the fluid pressure 202 may be increased to a second pressure greater than the first pressure and otherwise sufficient to shear the shearable members 150, and thereby allow the telescoping base 148 to break free from the tubing string 106 and radially advance through the aperture 146. In other embodiments, however, the first pressure may be sufficient to shear both the mandrel shearable member(s) 132 and the shearable members 150. In such embodiments, the fluid pressure 202 need only be increased to the first pressure to move the travelling mandrel 116 to the second position and to actuate the telescoping base 148 to the intermediate position.

Further, the protruding portion of the telescoping base 148 may sealingly engage the seals 152 to maintain a sealed interface. In this way, if the fluid pressure 202 creates a greater force than the differential sticking force of the mud filter cake 108, a gap 302 may form between the exterior wall of the tubing string 106 and the mud filter cake 108 on the inner wall 110 of the wellbore 102. Those skilled in the art will readily appreciate, however, that the applied force may not overcome the differential sticking force of the mud filter cake 108, such that the protruding portion of the telescoping base 148 may enter (extend into) the mud filter cake 108 a short distance without shifting the tubing string 106 itself. In such a scenario, the fluid pressure applied within the tubing string 106 may be further increased to continue the process of expanding (actuating) the telescoping cylinder 144, as discussed below.

In some embodiments, the motion of the telescoping cylinder 144 to the intermediate position may be sufficient for the unsticking of the tubing string 106, such that no further action may be required. However, in some embodiments, the apparatus 112 may need to be actuated further to unstick the tubing string 106.

Figure 4:
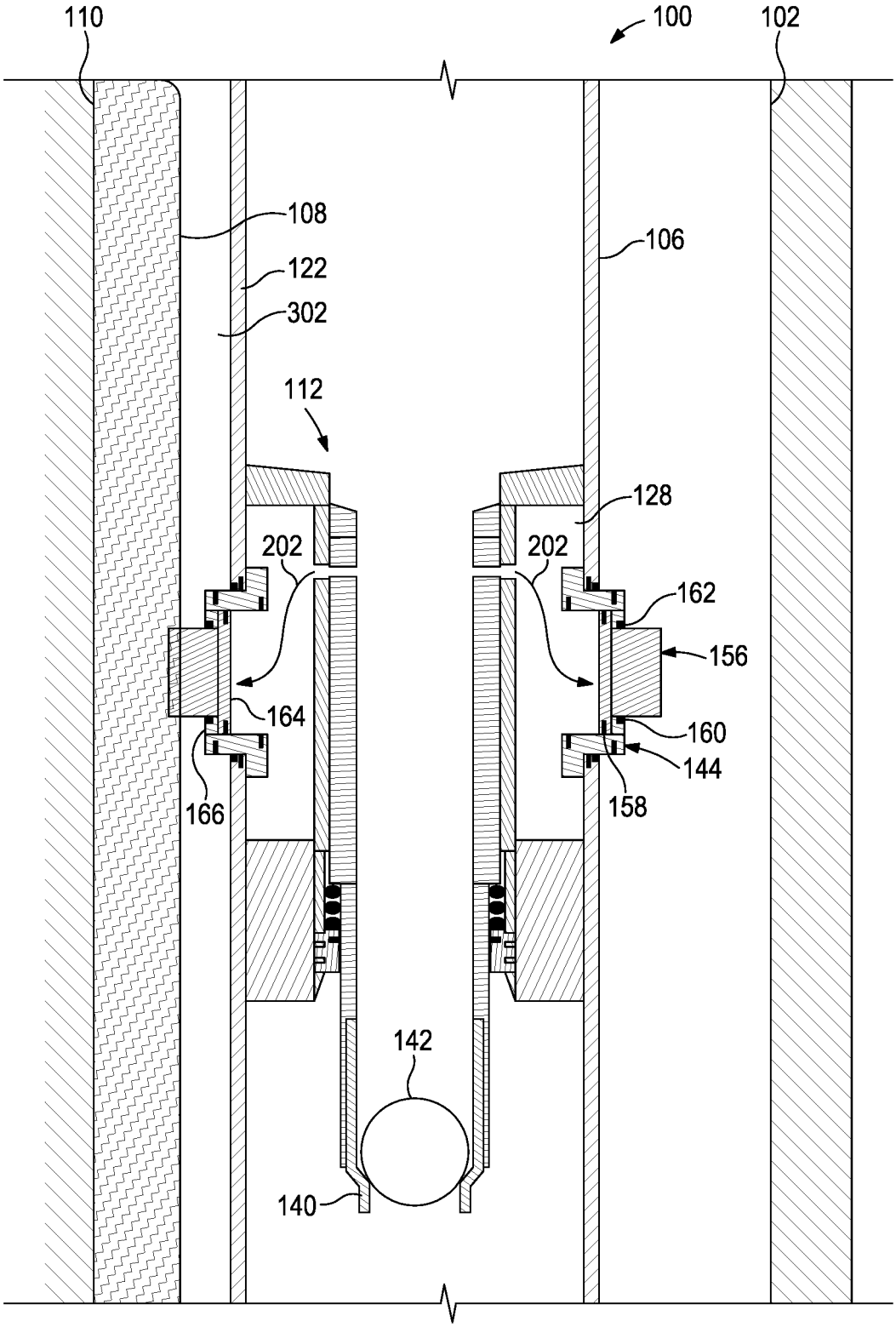

In FIG. 4, the telescoping cylinders 144 have been fully extended (actuated) as acted upon by an increased fluid pressure 202. More specifically, if actuating the telescoping cylinders 144 to the intermediate position does not unstick (dislodge) the tubing string 106 from the mud filter cake 108, the fluid pressure 202 within the tubing string 106 may be further increased. The increased fluid pressure 202 will act on the telescoping cylinders 144 within the telescope chamber 128, and thereby urge the telescoping cylinders 144 to transition from the intermediate position, as shown in FIG. 3, to a third or "extended" position, as shown in FIG. 4.

To transition the telescoping cylinders 144 to the extended position, the fluid pressure 202 may be increased to a third pressure greater than the second pressure (or greater than the first pressure, if the first pressure is sufficient to shear both the mandrel shearable member(s) 132 and the shearable members 150). The third pressure (or the second pressure) may be sufficient to shear the shearable members 158 securing the telescoping piston 156 to the telescoping base 148. Once the shearable members 158 are sheared, the telescoping piston 156 may move radially outward and through the central orifice 160. The telescoping piston 156 may continue to move radially outward until the enlarged base portion 164 abuts (engages) the radially protruding member 166, and thus prevents further radial travel. As the telescoping piston 156 extends through the central orifice, the seals 162 maintain a sealed interface between the two structures.

In some embodiments, the telescoping piston 156 may be defined by a surface diameter ranging from about one inch to about two inches. With respect to the various shearable members (132, 150, 158) discussed herein, those having skill in the art will appreciate that each shearable member 132, 150, 158 may be rated to withstand a specific shearing force, such that the successive telescoping may occur as fluid pressure 202 is progressively increased.

As the telescoping piston 156 extends radially outward and towards the mud filter cake 108, the gap 302 may increase in size, such that the majority of the inner wall 122 of the tubing string 106 may be separated from the mud filter cake 108. In the case previously discussed, in which the gap 302 is not generated with the partial extension of the telescoping cylinder 144, the full motion of the telescoping piston 156 of the telescoping cylinder 144 may be sufficient to create the gap 302. Once the gap 302 is generated, the rotation or reciprocation of the tubing string 106 may be further attempted. With the surface area in contact with the mud filter cake 108 reduced to the surface of the telescoping piston of the telescoping cylinder 144, the rotation or reciprocation may be sufficient for the unsticking of the tubing string 106.

It should be noted that the rotation or reciprocation after actuation of the telescoping cylinder 144 to the extended position may be combined with traditional unsticking techniques, such as the application of spotting fluid. Those skilled in the art will readily appreciate that, while only two telescoping actions are shown in the illustrated embodiment, any number of telescoping actions may be present within the telescoping cylinder 144 without departing from the scope of this disclosure. However, in the case in which the telescoping pistons 156 and the telescoping cylinders 144 fail to separate the tubing string 106 from the mud filter cake 108, further actions may be taken to continue the separation attempt.

Figure 5:
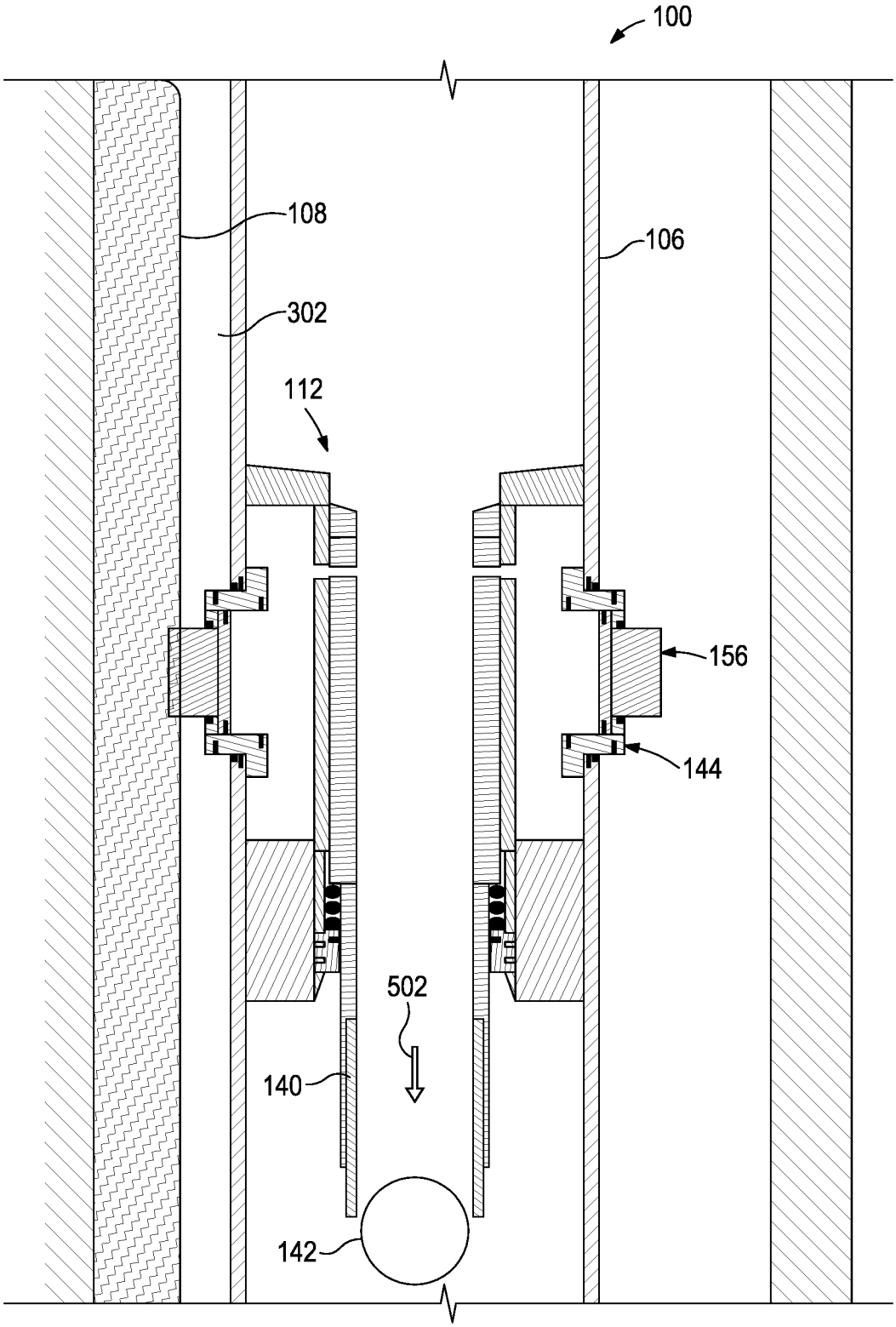

In FIG. 5, further action may be undertaken in the well system 100 if actuating the telescoping cylinders 144 to the extended position fails to dislodge the tubing string 106 from the mud filter cake 108. More particularly, there may be applications in which the activation of the telescoping cylinders 144 fails to unstick the tubing string 106 or create a large enough gap 302. In these applications, the fluid pressure 502 within the tubing string 106 may be increased even further to act on the wellbore projectile 142 received at the projectile seat 140. The fluid pressure 502 may be increased to a fourth pressure greater than the third pressure and otherwise to a point where the wellbore projectile 142 shears or plastically deforms the projectile seat 140, thus extruding the wellbore projectile 142 and enabling continued travel downhole. In such embodiments, the well system 100 may include additional instances of the apparatus 112 at one or more downhole locations. The wellbore projectile 142 may locate and be received by such apparatus 112, in which the process outlined herein may begin anew in a renewed effort to unstick the tubing string 106 from the mud filter cake 108 using one or more additional telescoping cylinders 144 with the same wellbore projectile 142.

Figure 6:
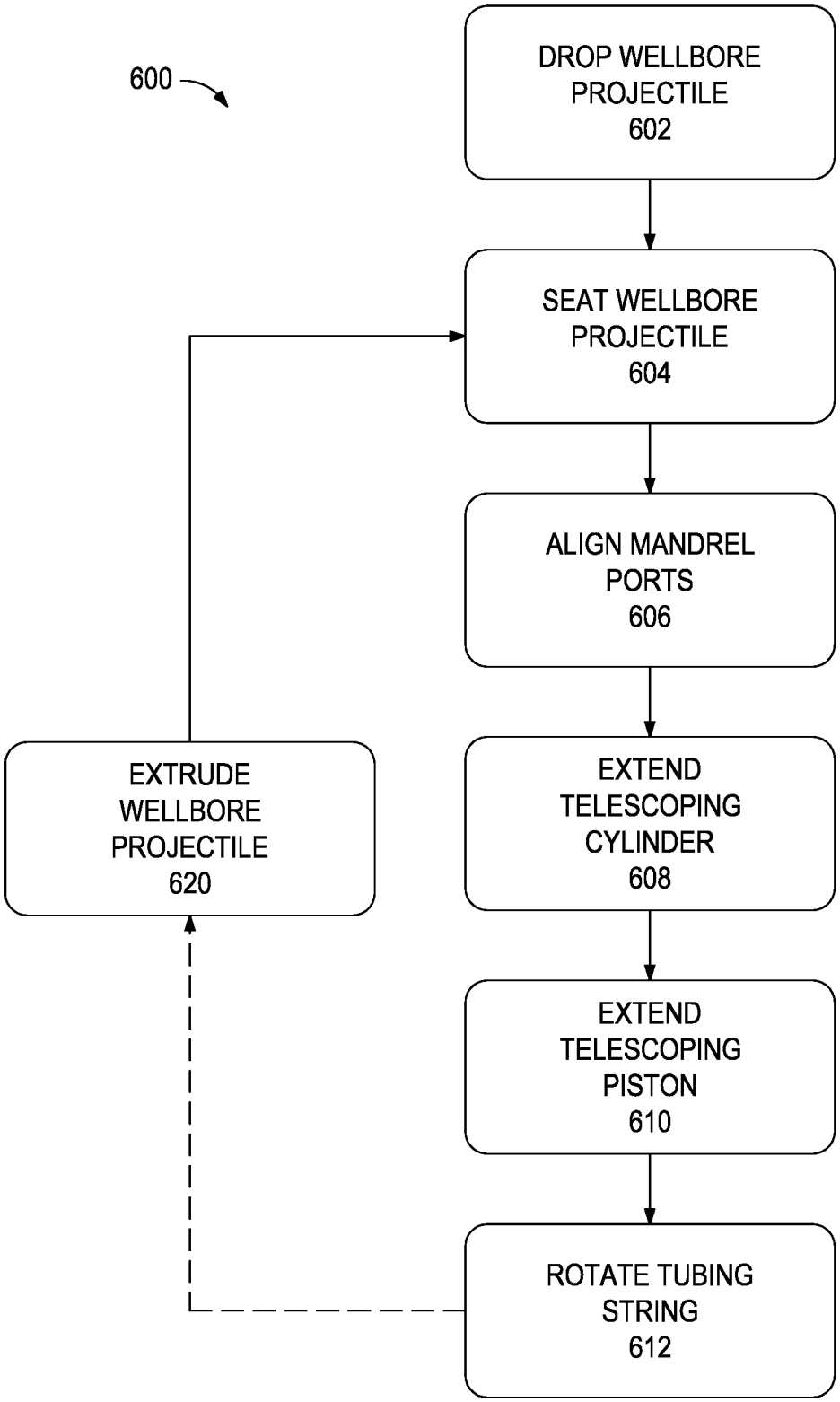
FIG. 6 is a schematic flowchart of an example method for unsticking a differentially stuck tubing string in accordance with the principles of the present disclosure.

FIG. 6 is a schematic flowchart of an example method 600 for unsticking a differentially stuck tubing string (e.g., the tubing string 106 of FIG. 1). Upon determination that the tubing string is differentially stuck within mud filter cake (e.g., the mud filter cake 108 of FIG. 1), the method 600 may begin at 602 with the dropping of a wellbore projectile (e.g., the wellbore projectile 142 of FIG. 1). As part of 602, the wellbore projectile may also be chased down the tubing string to ensure the wellbore projectile reaches a tubing string release apparatus (e.g., the apparatus 112 of FIG. 1). After dropping and chasing the wellbore projectile down the tubing string, the wellbore projectile may be seated upon (received by) a projectile seat (e.g., the projectile seat 140 of FIG. 1), as at 604. The projectile seat may be connected to a travelling mandrel (e.g., the travelling mandrel 116 of FIG. 1), such that increasing a fluid pressure within the tubing string may begin to move the travelling mandrel. As the fluid pressure (e.g., the fluid pressure 202 of FIG. 2) increases, the travelling mandrel will translate to a position where ports on the fixed and travelling mandrels (e.g., first and second ports 130*a,b* of FIG. 1) may align to form a passageway for fluid pressure to reach a telescoping cylinder (e.g., telescoping cylinder 144 of FIG. 1), as at 606. With the opening of a passageway during the alignment of the mandrel ports, the fluid pressure increase may propagate into a telescope chamber (e.g., the telescope chamber 128 of FIG. 1) that houses the telescoping cylinder. With an increase of the fluid pressure within the telescope chamber, a shearable member (e.g., the shearable members 150 of FIG. 1) may shear and enable a first length of the telescoping cylinder to extend and protrude from the tubing string, as at 608. This initial extension of the telescoping cylinder may or may not create a gap between the mud filter cake and the tubing string (e.g., gap 302 of FIG. 3). If the gap is not formed or if the gap must be increased in size, the pressure may further increase to cause a second shearable member (e.g., the shearable members 158 of FIG. 1) to shear such that a telescoping piston (e.g., the telescoping piston 156 of FIG. 1) may extend, as at 610. Through this extension of the telescoping piston, the gap may be created or further increased such that only a surface of the telescoping piston remains in contact with the mud filter cake. Those skilled in the art will readily appreciate that further extensions of a telescoping cylinder or telescoping piston may be performed herein without departing from the scope of this disclosure, such that the gap is further increased.

After the telescoping piston is fully extended, the tubing string may be rotated or reciprocated in an attempt to fully free from the mud filter cake, as at 612. It should be noted that the rotation or reciprocation of the tubing string may be combined with traditional unsticking techniques, such as the application of spotting fluid, without departing from the scope of this disclosure. If the previous method steps are sufficient for freeing the tubing string from the mud filter cake, the method may conclude with this rotation or reciprocation. However, if the extension of the telescoping piston fails to fully unstick the tubing string, the method may optionally advance by increasing the fluid pressure further such that the wellbore projectile is extruded from (through) the projectile seat, as at 620. In this case, the projectile seat may plastically deform or shear such that the wellbore projectile may continue downhole within the tubing string to another telescoping apparatus, which may be similar to the original telescoping apparatus or differently sized and oriented. At this point, the method 600 may continue with the seating of the wellbore projectile at a second or subsequent telescoping apparatus, as at 604.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A tubing string release apparatus, comprising:

a first mandrel configured to be fixed to an inner wall of a tubing string extended within a wellbore, the first mandrel defining a telescope chamber and a first port that facilitates fluid communication into the telescope chamber;

a second mandrel slidably arranged against the first mandrel and defining a second port, the second mandrel being movable between a first position, where the first and second ports are misaligned, and a second position, where the first and second ports are aligned and fluid pressure is able to enter the telescope chamber via the first and second ports; and a telescoping cylinder arranged within the telescope chamber and including a telescoping base releasably coupled to the tubing string at an aperture defined in the tubing string, and a telescoping piston releasably coupled to the telescoping base, wherein the telescoping base is released from the tubing string and advanced radially outward through the aperture when a pressure within the tubing string is increased to a first pressure, and wherein the telescoping piston is released from the telescoping base and advanced radially outward through a central orifice defined by the telescoping base when the pressure within the tubing string is increased to a second pressure greater than the first pressure.

2. The tubing string release apparatus of claim 1, further comprising a projectile seat coupled to the second mandrel at a location downhole from the second port, the projectile seat being configured to receive and sealingly engage a wellbore projectile introduced into the tubing string, wherein increasing a pressure within the tubing string once the wellbore projectile is received at the projectile seat moves the second mandrel from the first position to the second position.

3. The tubing string release apparatus of claim 2, wherein the second mandrel is releasably attached to the first mandrel using one or more mandrel shearable members, and increasing the pressure within the tubing string shears the one or more mandrel shearable members.

4. The tubing string release apparatus of claim 2, further comprising a compression spring that biases the second mandrel to the first position.

5. The tubing string release apparatus of claim 2, wherein the wellbore projectile is advanced through the projectile seat by increasing the pressure within the tubing string to a third pressure greater than the second pressure.

6. The tubing string release apparatus of claim 1, wherein the telescoping base is releasably coupled to the tubing string at the aperture using one or more first shearable members configured to shear at the first pressure, and wherein the telescoping piston is releasably coupled to the telescoping base using one or more second shearable members configured to shear at the second pressure.

7. The tubing string release apparatus of claim 1, further comprising:

one or more first seals arranged at an interface between the telescoping base and the aperture in the tubing string; and one or more second seals arranged at an interface between the telescoping base and the telescoping piston.

8. A method, comprising:

introducing a wellbore projectile into a tubing string extended within a wellbore having a layer of mud filter cake formed on an inner surface of the wellbore, the tubing string including a tubing string release apparatus secured thereto and including:

a first mandrel fixed to an inner wall of the tubing string and defining a telescope chamber and a first port that facilitates fluid communication into the telescope chamber;

a second mandrel slidably arranged against the first mandrel and defining a second port axially alignable with the first port;

a projectile seat coupled to the second mandrel at a location downhole from the second port; and a telescoping cylinder arranged within the telescope chamber and including a telescoping base releasably coupled to the tubing string at an aperture defined in the tubing string, and a telescoping piston releasably coupled to the telescoping base;

receiving the wellbore projectile at the projectile seat;

increasing a pressure within the tubing string to a first pressure, and thereby moving the second mandrel from a first position, where the first and second ports are misaligned, to a second position, where the first and second ports are aligned to allow fluid pressure to enter the telescope chamber; and increasing the pressure within the tubing string to a second pressure and thereby releasing the telescoping base from the tubing string and advancing the telescoping base radially outward through the aperture and against the mud filter cake.

9. The method of claim 8, further comprising engaging the mud filter cake with the telescoping base and thereby urging the tubing string away from the mud filter cake.

10. The method of claim 8, further comprising:

increasing the pressure within the tubing string to a third pressure greater than the second pressure and thereby releasing the telescoping piston from the telescoping base;

advancing the telescoping piston radially outward through a central orifice defined by the telescoping base and engaging the mud filter cake; and urging the tubing string away from the mud filter cake with the telescoping piston.

11. The method of claim 10, wherein the telescoping base is releasably coupled to the tubing string at the aperture using one or more first shearable members, and the telescoping piston is releasably coupled to the telescoping base using one or more second shearable members, the method further comprising:

shearing the one or more first shearable members when the pressure within the tubing string is increased to the second pressure; and shearing the one or more second shearable members when the pressure within the tubing string is increased to the third pressure.

12. The method of claim 10, wherein one or more first seals are arranged at an interface between the telescoping base and the aperture in the tubing string, and one or more second seals are arranged at an interface between the telescoping base and the telescoping piston, the method further comprising:

generating a first sealed interface between the telescoping base and the aperture with the one or more first seals as the telescoping base extends through the aperture; and generating a second sealed interface between the telescoping base and the telescoping piston with the one or more second seals as the telescoping piston extends through the central orifice.

13. The method of claim 10, wherein the tubing string release apparatus is a first tubing string release apparatus, the method further comprising:

increasing the pressure within the tubing string to a fourth pressure greater than the third pressure and thereby advancing the wellbore projectile through the projectile seat; and receiving the wellbore projectile at a second tubing string release apparatus secured to the tubing string downhole from the first tubing string release apparatus.

14. The method of claim 8, wherein the second mandrel is releasably attached to the first mandrel using one or more mandrel shearable members, and wherein increasing the pressure within the tubing string to the first pressure comprises shearing the one or more mandrel shearable members.

15. The method of claim 14, wherein the tubing string release apparatus further includes a compression spring that biases the second mandrel to the first position, and wherein increasing the pressure within the tubing string to the first pressure further comprises compressing the compression spring as the second mandrel moves to the second position.

16. A tubing string release apparatus, comprising:

a telescope chamber fixed to an inner wall of a tubing string and defining a first port that facilitates fluid communication into the telescope chamber;

a mandrel slidably arranged against the telescope chamber and defining a second port, the mandrel being movable between a first position, where the first and second ports are misaligned, and a second position, where the first and second ports are aligned and fluid pressure is able to enter the telescope chamber via the first and second ports; and a telescoping cylinder arranged within the telescope chamber and including a telescoping base releasably coupled to the tubing string at an aperture defined in the tubing string, and a telescoping piston releasably coupled to the telescoping base.

17. The tubing release apparatus of claim 16, wherein the telescoping base is released from the tubing string and advanced radially outward through the aperture when a pressure within the tubing string is increased to a first pressure.

18. The tubing release apparatus of claim 17, wherein the telescoping piston is released from the telescoping base and advanced radially outward through a central orifice defined by the telescoping base when the pressure within the tubing string is increased to a second pressure greater than the first pressure.

19. The tubing release apparatus of claim 17, wherein the telescoping base includes an enlarged base portion engageable with the inner wall of the tubing string to prevent further radial outward movement of the telescoping base.

20. The tubing release apparatus of claim 16, further comprising one or more additional telescoping cylinders spaced around a circumference of the tubing string.

* * * * *